US007770559B2

(12) United States Patent
Cobb, Jr.

(10) Patent No.: US 7,770,559 B2
(45) Date of Patent: Aug. 10, 2010

(54) DIAPHRAGM CARBURETTOR WITH ELECTROMAGNETIC ACTUATOR

(75) Inventor: William T. Cobb, Jr., St. Petersburg, FL (US)

(73) Assignee: Selettra S.R.L., Bentivoglio, Bologna (IT)

( * ) Notice: Subject to any disclaimer, the term of this patent is extended or adjusted under 35 U.S.C. 154(b) by 379 days.

(21) Appl. No.: 11/873,742

(22) Filed: Oct. 17, 2007

(65) Prior Publication Data

US 2008/0203344 A1 Aug. 28, 2008

Related U.S. Application Data

(60) Provisional application No. 60/852,006, filed on Oct. 17, 2006.

(51) Int. Cl.
*F02D 41/00* (2006.01)
*F02M 1/00* (2006.01)

(52) U.S. Cl. ..... 123/360; 261/38

(58) Field of Classification Search ..... 123/360, 123/361, 376, 478, 480, 590; 261/38, 36.2, 261/39.2, 40, 44.3, 46, 47, 55, 56
See application file for complete search history.

(56) References Cited

U.S. PATENT DOCUMENTS

| | | | | |
|---|---|---|---|---|
| 4,796,583 | A * | 1/1989 | Nagasaka et al. | 123/378 |
| 4,986,229 | A * | 1/1991 | Suzuki et al. | 123/179.16 |
| 6,585,235 | B2 * | 7/2003 | Pattullo | 261/44.8 |
| 6,672,570 | B2 * | 1/2004 | Takano et al. | 261/39.2 |
| 2002/0148419 | A1 * | 10/2002 | Hironaka et al. | 123/73 A |
| 2006/0151894 | A1 * | 7/2006 | Burns et al. | 261/47 |

* cited by examiner

*Primary Examiner*—John T Kwon
(74) *Attorney, Agent, or Firm*—Browdy and Neimark, PLLC

(57) ABSTRACT

A diaphragm carburettor comprises a diaphragm dosager (2) provided with a diaphragm (3) that separates a first chamber at constant pressure (4) from a second fuel dosaging chamber (5) intercepted by a valve controlled by the diaphragm, said valve being operatively connected with said diaphragm (3), the aforementioned carburettor also foreseeing an electromagnetic actuator (1) associated with said diaphragm (3) to control the opening and closing of said valve, where said actuator (1) also comprises at least one mobile coil (6) directly fixed to the diaphragm, and a fixed magnetic field generator (7) suitable for guiding said coil (6).

10 Claims, 3 Drawing Sheets

DIAPHRAGM CARBURETTOR WITH ELECTROMAGNETIC ACTUATOR

The present invention refers to a diaphragm carburettor with electromagnetic actuator.

More specifically, the present invention refers to a carburettor for small internal combustion engines suitable for being applied onto portable devices, like for example hedge trimmers, lawnmowers, chainsaws, grass-blowers and similar.

As known, diaphragm carburettors are used in small engines that must be able to operate in any position, in which common carburettors having a tank with a float cannot be used.

Diaphragm carburettors use a diaphragm dosager comprising a diaphragm that separates a dosaging chamber from a sealed chamber under constant pressure, generally atmospheric pressure.

Conventionally, the diaphragm dosager has a diaphragm the centre of which rests against an end of a lever, which is hinged in the dosaging chamber. The opposite end of the lever, on the opposite side to the pin, presses against a needle valve, also arranged in the dosaging chamber, preventing fuel from entering the chamber. The lever and the valve associated with it are held in closed position through a spring. The inner movement of the diaphragm, caused when the dosaging chamber has a pressure lower than atmospheric pressure, causes the needle valve to open, in contrast to the spring. Therefore, the dosaging chamber fills up and the pressure is restored close to atmospheric pressure. Alternatively, the dosaging system can have a different valve actuated to open directly by the inner movement of the diaphragm, without using the lever, and with the same functionality as the common conventional configuration.

The balancing of the pressures carried out on the diaphragm on the two sides, also taking into account the movement of the diaphragm transmitted to the valve, ensure that the pressure in the dosaging chamber is equal to or slightly less than atmospheric pressure. In applications on single-cylinder motors it can be observed that the action of the diaphragm dosager and of the annexed needle valve occurs in synchrony with the movement of the piston in the motor, and that the dosager operates intermittently.

Although the movement of the diaphragm generated by the pressure difference on the two faces of the diaphragm allows acceptable operation of the motor, however, to improve the performance of the motor, electrically actuated actuators are increasingly used, which "correct" the pressure exerted on the diaphragm through the addition of an electromagnetic force, so as to control the flow of fuel to be fed to the motor.

Known actuators do not always meet the user's requirements satisfactorily. The use of diaphragm carburettors requires that various demands be met. First of all, the carburettor must be produced at a low cost due to the impact of its cost on the end products in which it is usually applied. Moreover, it must be able to operate in any position of use and thus have a dosager the properties of which do not change based upon the position of the carburettor/motor. Finally, it must be able to operate at high speeds and in areas where high vibrations are generated. In some cases, a manual pump is implemented so as to reload fuel into the circuit when it is empty, typically after a long period without being used. One of the effects of manual pumping is the large displacement of the diaphragm; therefore all of the components of the dosager must allow it.

Thus, there is a great need to have a diaphragm carburettor that, in meeting the aforementioned requirements, has an actuator of the diaphragm that allows electronic control of its behaviour.

The purpose of the present invention is to provide a diaphragm carburettor with electromagnetic actuator having structural and functional characteristics that allows the aforementioned requirements to be met.

Such a purpose is accomplished through a carburettor in accordance with claim 1.

The dependent claims outline preferred and particularly advantageous embodiments of the carburettor according to the invention.

Further characteristics and advantages of the invention shall become clearer from reading the following description, provided as an example and not limiting purposes, with the help of the figures illustrated in the attached tables, in which.

Figure 1:
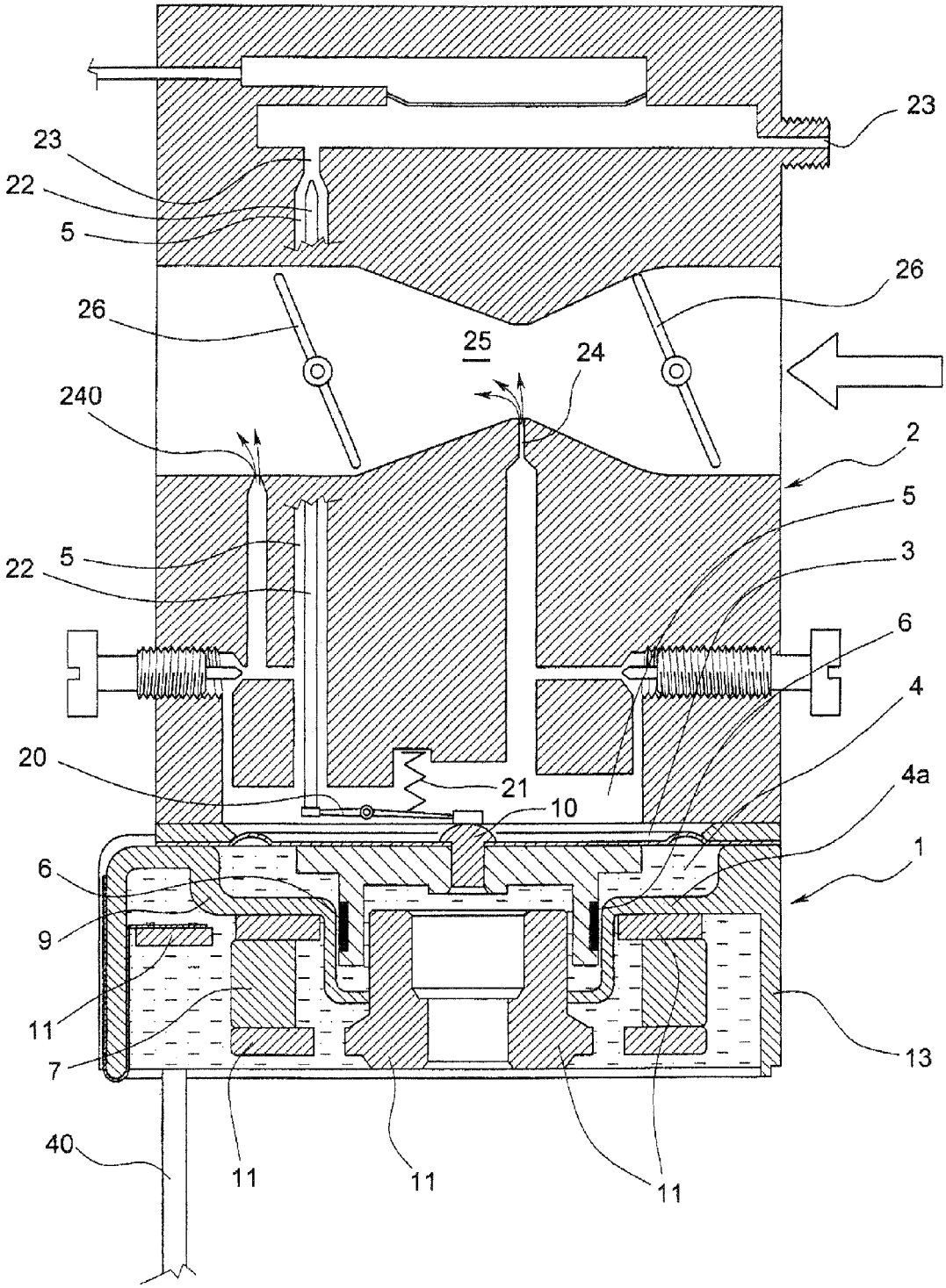
FIG. 1 shows a section view of an actuator applied to a dosaging device of a diaphragm carburettor, according to the present invention.

With reference to the aforementioned figures, an electromagnetic actuator, applied to a dosaging device 2 of a diaphragm carburettor, in accordance with the present invention, is globally indicated with 1.

The diaphragm dosager 2 comprises a diaphragm 3 that keeps a chamber at constant pressure 4, generally at atmospheric pressure, separate from a dosaging chamber 5, only partially visible, communicating both with a fuel inlet line 23 intercepted by a needle valve 22 controlled by the diaphragm 3 itself, and with a nozzle 24 for injecting fuel into the fuel inlet duct equipped with a Venturi tube 25 and with a pair of butterfly valves 26.

The chamber 5 communicates with the inlet duct also through the low speed nozzle 240.

The needle valve is controlled by the diaphragm 3 through a lever 20 that acts in contrast to a spring 21, as known in the art and therefore not described in detail.

The diaphragm dosager 2 is actuated by the pressure difference between the chamber at constant pressure 4 and the dosaging chamber 5.

In particular and as known, when there are depressions in the dosaging chamber 5, the atmospheric pressure present in the other chamber 4 exerts a sufficient force against the diaphragm 3 to deform it towards the inside of the dosaging chamber 5, consequently pushing the lever 20 that opens the needle valve. When the pressure inside the dosaging chamber 5 goes back to a value substantially equal to that present in the other chamber 4, i.e. atmospheric pressure, the diaphragm 3 goes back into the relaxed and undeformed position, the spring 21 takes the lever 20 back into the initial position, taking the valve back into the closed position.

In accordance with the present invention, the diaphragm 3 is further controlled through the electromagnetic actuator 1.

The actuator 1 is made up of a mobile coil 6 arranged entirely in the chamber at constant pressure 4 and directly fixed to the diaphragm 3, and a fixed magnetic field generator, in the example a permanent magnet ring 7 associated with field guides 11, which shall be discussed more later on. The passing of current through the coil 6 generates an actuation force applied to the dosager 2 of the carburettor so as to influence the dosage of fuel to the motor.

The inversion of the direction of the flow of current generates a force in the opposite direction on the diaphragm 3, and the actuator 1 is thus able to generate a force in both directions on the diaphragm 3, by simply inverting the polarity of the coil 6.

In particular, the coil 6 is wound on a support 9 made from light plastic and shaped like a cup with the base fixed, through a rivet 10, centrally to the diaphragm 3 itself, on the side of the chamber at constant pressure 4.

The coil 6 is positioned with its central axis perpendicular to the surface of the diaphragm 3 and centrally with respect to the dosaging chamber 5.

In the example, the head of the rivet 10 projects into the dosaging chamber 5 so as to act as a connection head to the end of the lever 20 in contact with the diaphragm 3.

The electrical connections with the coil 6 can be made in accordance with the known art.

In particular and in order to ensure high flexibility of use, good strength also in the presence of high vibrations as well as low production costs, such connections can be made through the use of a plurality of thin strands to form the winding, at each of the two ends forming a plait. These plaits are thus used to project from the space present between the coil 6, fixed to the diaphragm 3 and free to move, and the fixed parts of the carburettor to connect with the fixed cables 40 from which the electricity arrives.

Figure 2:
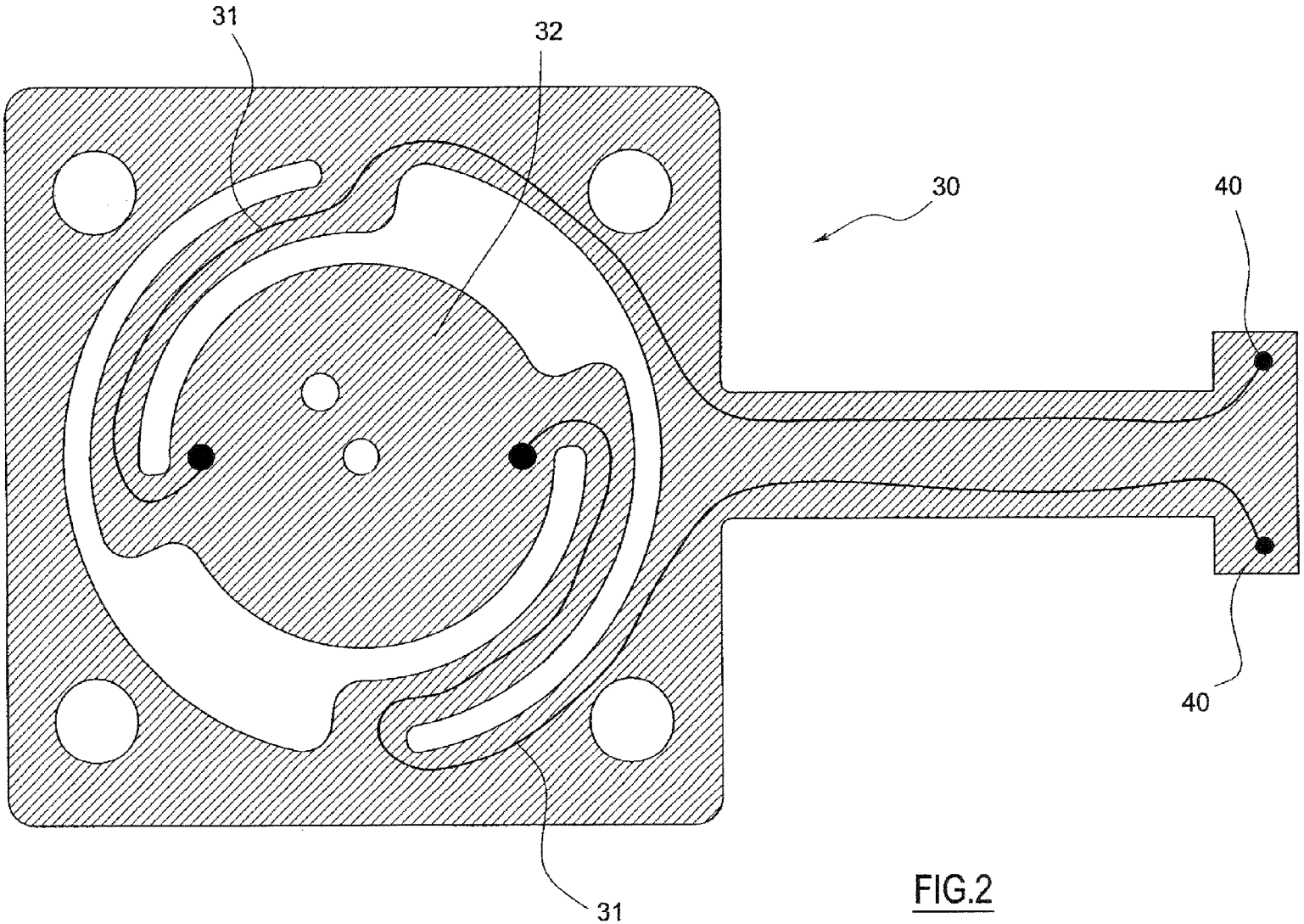
FIG. 2 shows a plan view of a flexible circuit element to be used in the actuator of FIG. 1.
Figure 3:
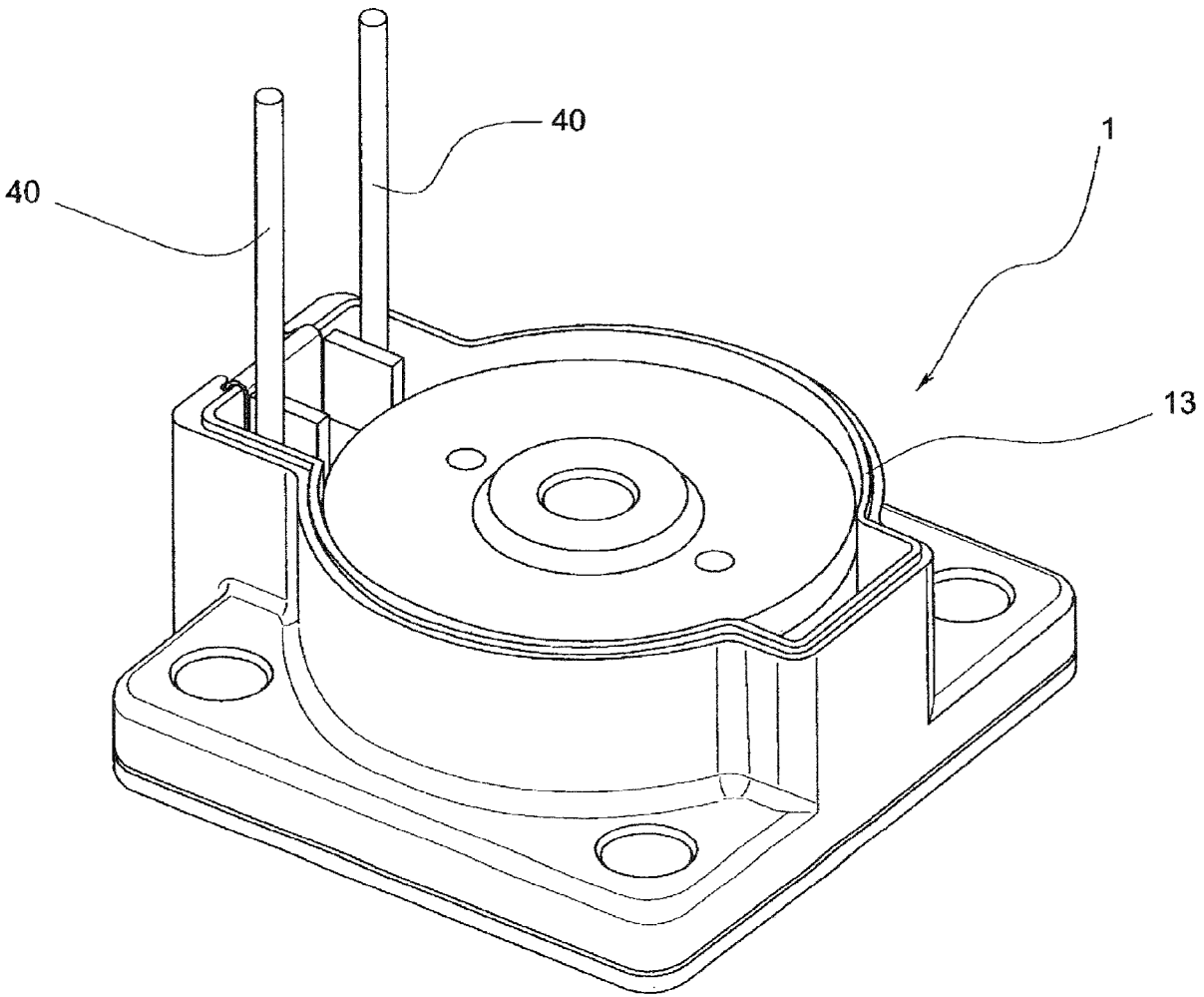
FIG. 3 shows a perspective view of the assembly of FIG. 1.

Alternatively, in order to ensure the flexible connections to the coil 6, it is foreseen to use a flexible circuit element 30 (FIG. 2).

Such a circuit 30 is formed through a printed copper circuit on a flexible base material like, for example, Mylar or Kapton. The circuit 30 is cut so as to form thin and flexible arms 31 containing the circuit tracks that extend through the space of the mobile coil 6. Thanks to this flexible circuit 30 it is possible to place it between the diaphragm 3 and the coil 6 and join it to them so as to obtain a reduction in costs.

In order to have a robust and efficient actuator it is necessary to generate a strong magnetic field. To generate this field it is thus necessary to have a relatively large magnetic mass. The permanent magnet 7, according to the present invention, is mounted on the fixed portion of the carburettor and not on the diaphragm as occurs in the prior art.

In particular, the magnet 7, in the example, has an annular configuration, however it is possible to use any other configuration like for example disc-shaped.

The field guides 11, made from iron, guide the magnetic circuit and allow the coil 6 to be housed leaving extremely small spaces from the magnet 7. Thanks to the possibility of making a magnetic circuit with such small spaces, the density of the magnetic flow and therefore the efficiency of the actuator can be enormously increased, so as to be able to function even with little energy.

The magnet 7 and the guides 11 are housed inside a cylindrical casing 13 made from plastic material.

In particular, the diaphragm 3 is fixed onto the base of the casing 13, with the chamber at constant pressure 4 formed inside it. Such a chamber 4 has a bell-shaped configuration with an annular shoulder 4*a* supporting the magnet 7 arranged between two annular elements forming the field guides 11. Centrally, the chamber 4 has a hole through which a further element passes forming the field guides 11 that is placed partially inside the support 9 without touching it however.

In practice, the magnet 7 and the guides 11 are neither directly nor indirectly in contact with the diaphragm 3.

The casing 13 is easy to make and adapt to any type of carburettor.

As can be appreciated from what has been described, the diaphragm carburettor with electromagnetic actuator according to the present invention allows the requirements mentioned in the introductory part of the present description to be met.

The described invention has numerous and important advantages.

The described actuator is able to optimally correct the position of pressure equilibrium of the diaphragm of the dosager, using a variable amount of force that can be controlled electronically. Moreover, the actuator of the invention can also be applied to a low-cost carburettor, without impairing the behaviour of the entire system, as well as being able to operate in an environment with high vibrations, thanks to its compactness.

The actuator of the invention is also structured in such as way as to allow a large displacement of the diaphragm and therefore to support a manual pump that does, indeed, cause said effect.

The actuator consumes a small amount of electricity and can therefore be applied to products that generate a small available current, with great versatility of use.

The actuator, thanks to its compactness and its design characteristics, can easily be adapted to multiple applications with small modifications to the pre-existing system, or else to the system to which it must be applied.

In the invention, the portion of actuator that is attached to the diaphragm dosager is light. This characteristic, on the one hand, prevents the force of gravity that acts upon the actuator from being able to alter its behaviour in the different positions in which the motor is operated. On the other hand, the light weight does not change the behaviour of the actuator when there are large vibrations and allows high actuation speed to be reached even at low powers.

The described actuator is highly versatile: indeed, it has been seen that it is able to produce a force in both directions and the direction of the force can easily be selected in a single direction or two-directional. Moreover, the actuation force of the actuator is easy to control in a simple and functional manner.

The described actuator is also electrically efficient in the sense that the actuation force is generated with low energy consumption.

It also has excellent electrical insulation, advantageous considering the fact that it is an electrical device that is in contact with flammable substances, like the fuel.

The electrical circuits of the actuator are designed according to safety standards, known in the field of petrochemistry. This is obtained precisely because the energy contained in the reactive components is less than that required to inflame the flammable substances used. Added to this is the fact that low energy means low consumption, and therefore high efficiency. Finally, the actuator has high strength, so as to reduce maintenance costs.

Of course, a man skilled in the art can make numerous modifications and variations to the carburettor described above, in order to satisfy contingent and specific requirements, all of which are also covered by the scope of protection of the invention, as defined by the following claims.

The invention claimed is:

1. Diaphragm carburettor comprising a diaphragm dosager (2) provided with a diaphragm (3) arranged so as to keep a first chamber at constant pressure (4) separate from a second chamber (5) communicating both with a fuel inlet line intercepted by a valve controlled by the diaphragm (3) itself, and with an outlet line for injecting fuel, said valve being operatively connected with said diaphragm (3), the aforementioned carburettor foreseeing an electromagnetic actuator (1) associated with said diaphragm (3) to control the opening and closing of said valve, characterised in that said actuator (1) comprises at least one mobile coil (6) arranged entirely in said first chamber (4) and directly fixed to said diaphragm (3), and a fixed magnetic field generator (7) suitable for guiding said coil (6), said actuator (1) controlling said diaphragm (3) and therefore said valve when electrical current passes through the coil (6).

2. Carburettor according to claim 1, in which said coil (6) is wound on an insulating support (9) fixed to the diaphragm (3) and free to slide with the wire of the coil with current passing through it wound on it.

3. Carburettor according to claim 2, in which said support (9) has a cup-shaped configuration with the base (9*a*) fixed centrally to the diaphragm (3), the side wall being at least partially wound by said coil.

4. Carburettor according to claim 3, in which said support (9) is made from plastic material and is fixed to the diaphragm (3) through fastening means (10) that project for a portion in said second chamber (5), said portion that projects being suitable for connecting with an actuation lever (20) of said valve.

5. Carburettor according to claim 1, in which said magnetic field generator consists of a permanent magnet (7) with associated field guides (11), said magnet (7) being arranged outside of said first chamber (4).

6. Carburettor according to claim 5, in which said magnet (7) has an annular configuration.

7. Carburettor according to claim 6, in which said magnet (7) is arranged inside a cylindrical casing (13) on a base of which said diaphragm (3) is fixed, said first chamber (4) being formed inside said casing (13).

8. Carburettor according to claim 7, in which said field guides (11) comprise a pair of opposite annular elements next to said magnet (7), which is arranged between them, and a further element having a cylindrical configuration and arranged partially inside said support (9) without touching it.

9. Carburettor according to claim 1, in which a flexible printed circuit (30), suitable for maintaining the electrical supply of said mobile coil (6) with a current generator, is arranged between said coil (6) and said diaphragm (3).

10. Carburettor according to claim 1, in which, through inversion of the direction of the flow of current, it is possible to invert the direction of the force acting upon the aforementioned diaphragm (3).

* * * * *